US005257471A

United States Patent [19]

Kitanaka

[11] Patent Number: 5,257,471

[45] Date of Patent: Nov. 2, 1993

[54] EXCAVATOR FOR FORMING UNDERGROUND CONTINUOUS WALL

[75] Inventor: Katsumi Kitanaka, Tokyo, Japan

[73] Assignee: Hokushin Kogyo Corporation, Tokyo, Japan

[21] Appl. No.: 899,894

[22] Filed: Jun. 17, 1992

[30] Foreign Application Priority Data

Jul. 10, 1991 [JP] Japan ..... 3-195049

[51] Int. Cl.[5] ..... E02F 5/06

[52] U.S. Cl. ..... 37/353; 37/355; 37/180; 37/465; 37/446

[58] Field of Search ..... 37/83, 84, 86, 104, 37/105, 141 R, 191 R, 191 A, 192 R, 192 A; 405/267

[56] References Cited

U.S. PATENT DOCUMENTS

| | | | |
|---|---|---|---|
| 419,401 | 1/1890 | Baldry et al. | 37/191 R |
| 471,920 | 3/1892 | Warren | 37/191 R |
| 594,141 | 11/1897 | Nettelbeck | 37/86 |
| 733,422 | 7/1903 | Raymond | 37/86 |
| 1,131,071 | 3/1915 | Monahan | 37/191 R |
| 1,802,106 | 4/1931 | Bosworth | 37/191 R |
| 2,648,145 | 8/1953 | Askue | 37/192 R |
| 2,981,012 | 4/1961 | Meyer | 37/86 |
| 4,843,742 | 7/1989 | Camelleri | 37/192 A X |

FOREIGN PATENT DOCUMENTS

| | | | |
|---|---|---|---|
| 19010 | 1/1905 | Austria | 37/191 R |
| 1634849 | 7/1970 | Fed. Rep. of Germany | 37/86 |
| 6012 | of 1882 | United Kingdom | 37/192 R |

*Primary Examiner*—Dennis L. Taylor
*Assistant Examiner*—Arlen L. Olsen
*Attorney, Agent, or Firm*—Stevens, Davis, Miller & Mosher

[57] ABSTRACT

An excavator for forming an underground continuous wall includes a traveling trolley movable on a ground and an upper frame constructed on the trolley. The excavator further includes a guide post vertically extending and vertically movably provided at one side of the upper frame on the trolley and variable in length by supplementary extension guide post members detachably connectable thereto through flanges. Chain sprockets rotatably provided on the guide post at its upper and lower ends and at one end rearward of the chain sprocket at the upper end of the guide post, respectively. An endless chain extends around the chain sprockets to be driven by rotation of at least one of the chain sprockets. A number of excavator buckets are provided on the endless chain therealong spaced at suitable intervals to form an endless chain bucket type cutter.

4 Claims, 4 Drawing Sheets

EXCAVATOR FOR FORMING UNDERGROUND CONTINUOUS WALL

BACKGROUND OF THE INVENTION

This invention relates to an excavator for excavating ground to form an underground continuous wall in civil engineering and construction works.

In forming such an underground continuous wall in the past, first a hole having an elliptical section having a 2 to 3 m major axis was dug in the ground to a predetermined depth by a powered bucket or a hole was dug to a predetermined depth by two or three series of auger drills. Alternatively a hole formed in a slurry was sealed with a bentonite solution to prevent further penetration of slurry, a reinforcing bar cage was set in the hole and a concrete-mix was poured into the hole to form a foundation column. Such a method was repeated to form an underground continuous wall.

With the underground continuous wall forming method of the prior art described above, the processes are complicated and hence take much time until the completion of the continuous wall. Moreover, slurry or bentonite solution layers at joints between successive columns interrupt formation of the continuous wall so that after completion of the wall, ground water tends to leak into the inside of the continuous wall through the joints. It is therefore very difficult to provide a continuous wall simultaneously having two functions as a foundation wall and a diaphragm wall.

SUMMARY OF THE INVENTION

It is, therefore, an object of the invention to provide an excavator for forming an underground continuous wall which has two functions, as a foundation wall and a diaphragm wall.

It is another object of the invention to provide an excavator which can form the underground continuous wall with very high efficiency without any risk of falling down, thereby ensuring the safety in working.

It is a further object of the invention to provide an excavator which performs its excavating operation in minimum time for the completion of the continuous wall and forms the continuous wall which is perfectly vertical and high in reliability.

In order to accomplish the above objects, the excavator for forming the underground continuous wall according to the invention comprises a traveling trolley movable on the ground in which the continuous wall is to be dug, an upper frame constructed on the trolley, a guide post variable in length and vertically extending and vertically movably provided at one side of the upper frame on the trolley, chain sprockets rotatably provided on the guide post at its upper and lower ends, respectively, a chain sprocket rotatably provided on the guide post at one end rearward of the chain sprocket at the upper end of the guide post, and an endless chain extending around the chain sprockets to be driven by rotation of at least one of the chain sprockets and having a number of excavator buckets spaced at suitable intervals along the endless chain to form an endless chain bucket type cutter.

In forming the underground continuous wall with the excavator according to the invention, first a vertical hole having a predetermined depth is formed at a point in the ground to be formed therein with the continuous wall, and the endless chain bucket type cutter is then assembled and set in the vertical hole. Thereafter, the cutter is rotated, while the traveling trolley is advanced to excavate continuously a grove corresponding to one side of the continuous wall to be formed. After the groove at the one side of the continuous wall has been excavated in this manner, the traveling trolley is once retracted and then advanced again to completely dredge or scrape various substances out of the excavated groove. Thereafter, reinforcing bar cages are settled in the whole groove and a ready mixed-concrete is then poured into the groove, thereby forming the underground continuous wall.

At the beginning of the excavating work, the hole may be formed to the predetermined depth directly by means of the endless chain bucket type cutter of the excavator according to the invention with using another excavator. Thereafter, the traveling trolley may be advanced to form the continuous wall as described above.

The excavator according to the invention can continuously excavate grooves for the underground continuous wall only by advancing the traveling trolley, while rotatively driving the endless chain bucket type cutter. Moreover, the earth and sand produced by the excavation are automatically exhausted onto a belt conveyor or a dump truck from the endless chain bucket type cutter when the endless chain is turned downwardly over the upper rear end portion of the guide post. Therefore, the excavator according to the invention can form the underground continuous wall with very high efficiency.

Furthermore, the excavator according to the invention has a long underground portion and a short portion above the ground surface so that constructional stability is high and hence there is no risk of falling down, thereby insuring safety in working.

The underground continuous wall formed by the excavator according to the invention does not have any joints in its wall surfaces so that there is no risk of ground water leaking through the wall. Therefore, the excavator according to the invention is able to form foundation walls in the ground and at the same time enables the foundation walls to be used as diaphragm walls.

As can be seen from the above explanation, the excavator according to the invention is able to form the whole of the one side of the continuous wall underground in the form of a single continuous wall without joints so that there is no water leakage and the underground wall itself can be advantageously used as a foundation of a building or structure. The continuous wall forming method by use of the excavator according to the invention is a continuous operation which reduces the time necessary for the completion of the work. Moreover, the groove excavated by the excavator according to the invention do not permit useless substances to stay in it and the underground wall is perfect in verticality, resulting in high reliability of the underground wall formed according to the invention.

The invention will be more fully understood by referring to the following detailed specification and claims taken in connection with the appended drawings.

DESCRIPTION OF THE PREFERRED EMBODIMENTS

Figure 1:
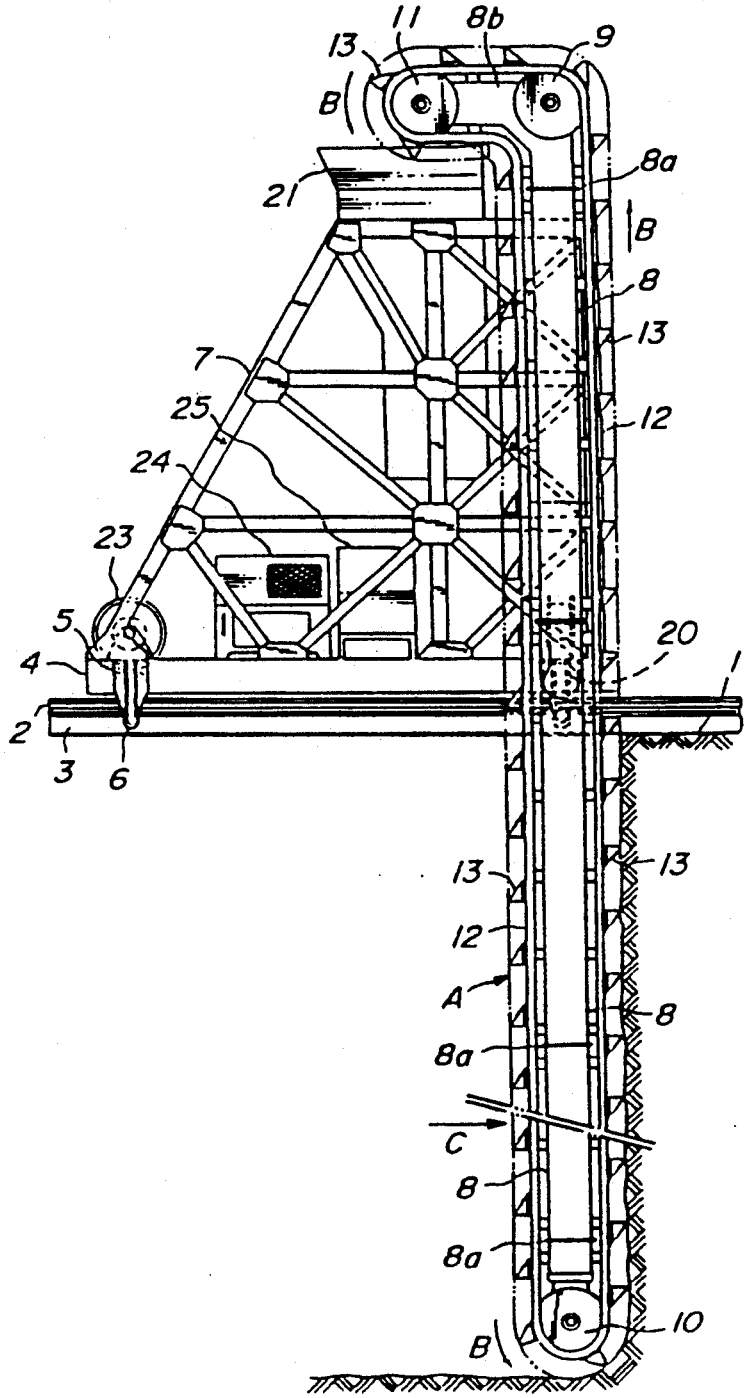
FIG. 1 is a side view illustrating the excavator according to the invention.

Referring to the drawings, reference numeral 1 denotes the ground or earth to be formed therein with a continuous wall. In the embodiment shown in the drawings, two rails 2 are arranged on lower frames 3, respectively, which are parallelly arranged on the ground 1 along the continuous wall to be formed. A traveling trolley 4 is movably located on the rails 2. The traveling trolley 4 has wheels 5 rolling on the rails 2 and rollers 6 for preventing the trolley 5 from falling down. The trolley 4 may be a vehicle having tires or a crawler other than the shown trolley 4 moving on the rails 2.

The trolley 4 is provided with an upper frame 7. The upper frame 7 is provided on one side with a vertically movable guide post 8. The guide post 8 includes flanges 8*a* which serve as joints for attaching supplementary extension guide post members which makes it possible to extend the length of the guide post 8. Chain sprockets 9 and 10 are rotatably supported at the upper and lower ends of the guide post 8 and a second chain sprocket 11 is also rotatably supported at the rear end of the extension 8*b* of the guide post 8 rearward extending from the first sprocket 9 at the upper end of the guide post 8. An endless chain 12 extends around the sprockets 9, 10 and 11 and is provided with a number of excavator buckets 13 spaced at suitable intervals along the endless chain 12 to form an endless chain bucket type cutter A. The endless chain 12 of the cutter A is adapted to be driven around the sprockets 9, 10 and 11, while the trolley 4 is adapted to be driven on the rails 2.

Figure 2:
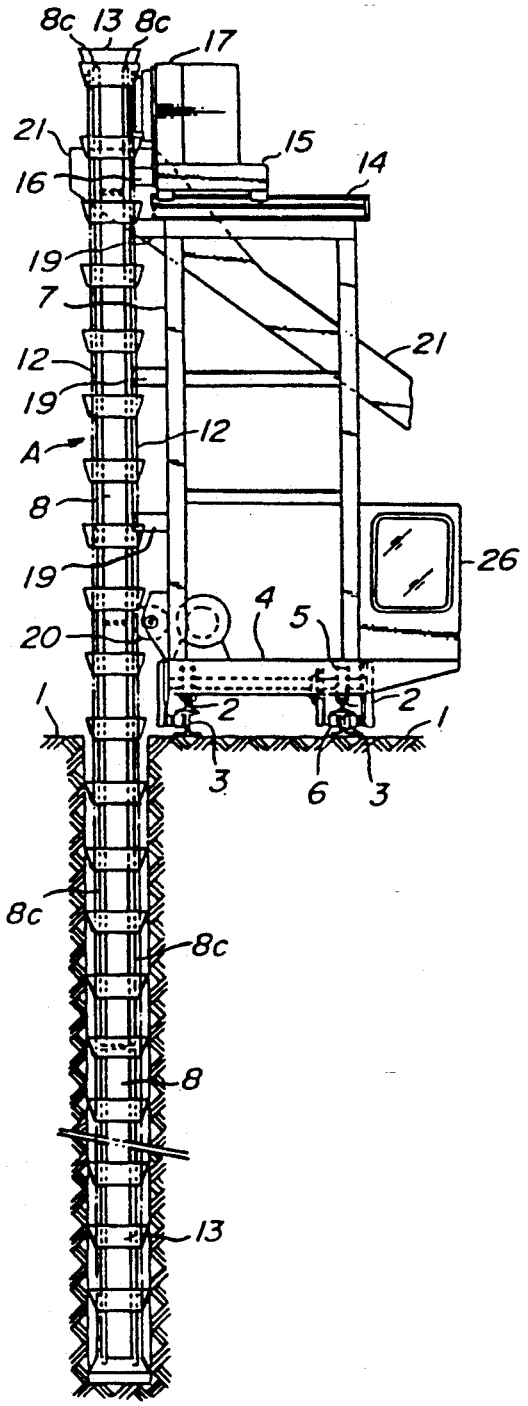
FIG. 2 is a front elevation of the excavator shown in FIG. 1.
Figure 3:
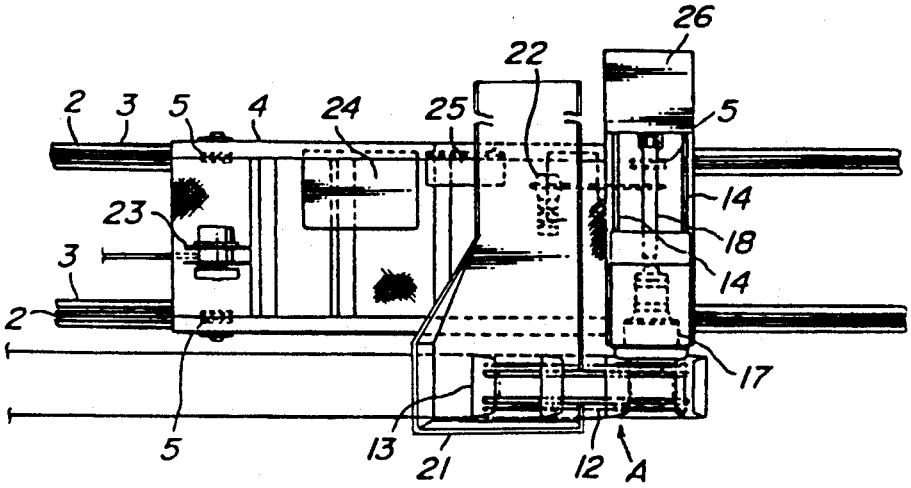
FIG. 3 is a plan view of the excavator shown in FIG. 1.

Two rails 14 extending perpendicularly relative to the rails 2 are provided on the top of the upper frame 7 (FIG. 2). A slide saddle 15 is arranged on the rails 14 and connected to the guide post 8 by means of a connecting bracket 16. A hydraulic motor 17 is provided on the slide saddle 15 for driving the endless chain bucket type cutter A. A hydraulic cylinder 18 is provided for slidingly moving the slide saddle 15 (FIG. 3). Brackets 19 are extended from the frame 7 to slidably support the guide post 8. A hydraulic winch 20 is provided on the frame 7 for vertically moving the guide post 8.

A hopper 21 is mounted on the frame 7 at a position below the rear end of the extension of the guide post for receiving the earth and sand produced in forming the continuous wall and exhausted from the buckets 13 of the endless chain bucket type cutter A, and includes a chute for discharging the received earth and sand out of the frame 7. The trolley is provided with a hydraulic motor 22 for driving it on the rails 2 (FIG. 3), a cable reel 23, a hydraulic unit 24 and a control panel 25. An operator's cabin 26 is arranged on the slide saddle 15.

Figure 4A:
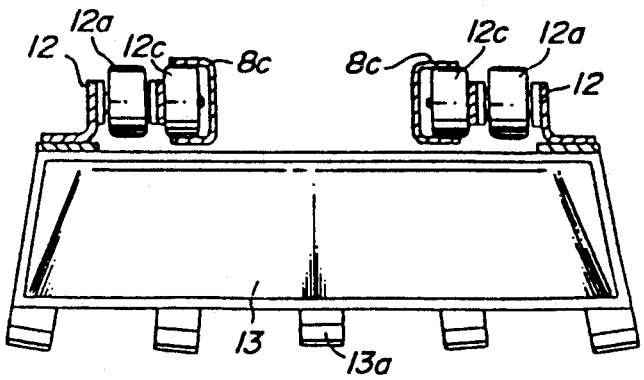
FIG. 4*a* is a plan view of an excavator bucket used in the excavator according to the invention.
Figure 4B:
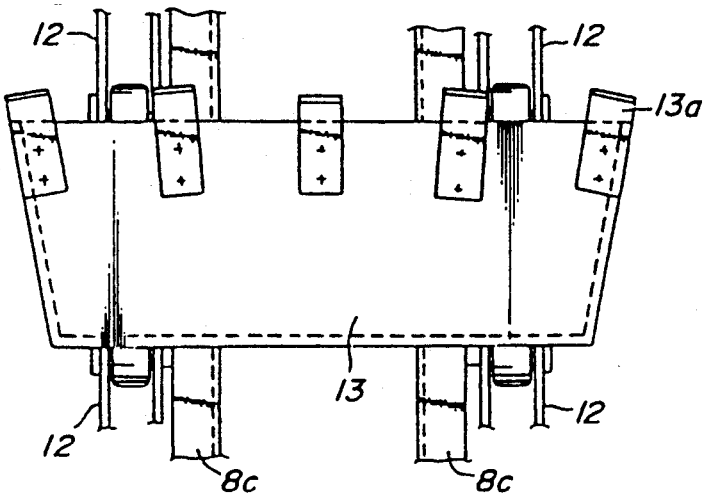
FIG. 4*b* is a front view of the bucket shown in FIG. 4*a*.
Figure 4C:
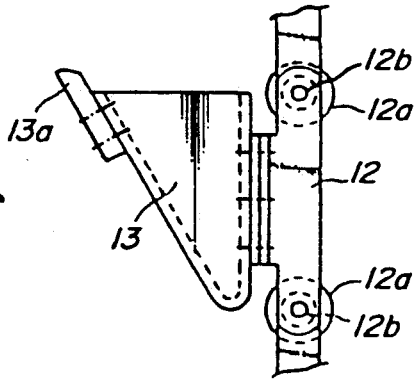
FIG. 4*c* is a side view of the bucket shown in FIG. 4*b*.

FIGS. 4*a*, 4*b* and 4*c* illustrate, by way of example, an excavator bucket 13, the endless chain 12 carrying the excavator buckets 13 and a guide device for the endless chain 12 of the endless chain bucket type cutter A. As shown in the drawings, a plurality of bits 13*a* are extended from the outer edges of the excavator bucket 13 spaced at suitable intervals. The bits 13*a* are preferably exchangeable, for example, for harder bits for cutting a concrete. Chain links of the endless chain 12 are connected by connecting pins 12*b* on which guide rollers 12*a* are rotatably supported at the outer side of the chain links and guide rollers 12*c* are rotatably supported at the inner side of the chain links. The guide rollers 12*c* are guided by guide rails 8*c* integrally connected to the guide post 8.

In forming the underground continuous wall with the excavator described above according to the invention, first a vertical hole (not shown) having a predetermined depth is dug at a point in the ground to be formed therein with the continuous wall, and the endless chain bucket type cutter A is then assembled and set in the vertical dug hole. Thereafter, the cutter A is rotated by means of the hydraulic motor 17 in the direction shown by an arrow B in FIG. 1, while the traveling trolley 4 is advanced by means of the hydraulic motor 22 in the direction shown by an arrow C in FIG. 1 to excavate continuously a groove at the one side of the continuous wall. After the groove at the one side of the continuous wall has been excavated in this manner, the trolley 4 is once retracted in the excavated groove and then advanced again so that various substances in the excavated groove are completely dredged or scraped out of the groove. Thereafter, reinforcing bar cages are settled all over the groove and a ready mixed-concrete is then poured into the groove.

In the case that an underground continuous wall of a square shape having four sides is formed, in order to form joints at corners in a watertight manner, the bits 13*a* of the excavator buckets 13 are exchanged for hard bits capable of cutting concrete and after the already set concrete at the corner end of the wall at the neighboring side has been cut to a certain extent, a ready mixed-concrete may be poured into the groove.

The endless chain bucket type cutter A used in the excavator according to the invention can excavate very deep grooves such as 20 m, 30 m or 50 m by once setting the guide post 8 and the endless chain 12 which have been extended with their supplementary extension members. After the guide post 8 and the endless chain 12 have been extended, it is possible to execute continuous excavation without requiring a long time as in the prior art bucket excavator using buckets one by one. Moreover, after the buckets 13 have been moved horizontally at the top of the cutter A, the earth and sand are automatically exhausted into the hopper 21 when the buckets 13 are turned downward. Therefore, the earth and sand may be discharged from the hopper 21 onto a belt conveyor or directly onto a dump truck.

As can be seen from the above description, the excavator according to the invention can continuously excavate the groove for an underground continuous wall only by advancing the traveling trolley 4, while driving the endless chain bucket type cutter A with very high efficiency and automatically exhausting the earth and sand produced by the excavation. Moreover, the excavator according to the invention is constructionally stable and hence there is no risk of it falling down. Furthermore, the excavator according to the invention can form the underground continuous wall without any joints in its wall surface so that there is no risk of ground water leaking through the wall which can be advantageously used as a foundation of a building or structure.

While the invention has been particularly shown and described with reference to preferred embodiments thereof, it will be understood by those skilled in the art that the foregoing and other changes in form and details can be made therein without departing from the scope of the invention.

What is claimed is:

1. An excavator for forming an underground continuous wall comprising a traveling trolley movable on a ground to be formed with the continuous wall therein, an upper frame constructed on the trolley, a guide post which is variable in length by means of supplementary extension guide post members detachably connectable by flanges, said guide post being vertically extending and vertically movably, said guide post being positioned at one side of the upper frame on the trolley, first upper and first lower chain sprockets rotatably provided on the guide post at its upper and lower ends, respectively, a second upper chain sprocket rotatably mounted rearward of the first upper chain sprocket at the upper end of the guide post, and an endless chain extending about the chain sprockets to be driven by rotation of at least one of the chain sprockets and having a number of excavator buckets spaced at suitable intervals along the endless chain to form an endless chain bucket type cutter.

2. The excavator as claimed in claim 1, wherein the excavator comprises brackets provided on the upper frame on the traveling trolley for slidably supporting the guide post and a hydraulic winch for vertically moving the guide post.

3. The excavator as claimed in claim 1, wherein the excavator comprises a hopper provided on the upper frame below the second upper sprocket at the upper end of the guide post and adapted for exhausting earth and sand received in the hopper out of the frame on the traveling trolley.

4. The excavator as claimed in claim 1, wherein each of the excavator buckets is provided with a plurality of spaced apart exchangeably mounted bits extending from its outer edge.

* * * * *